US010221589B2

(12) United States Patent
Roberts, III et al.

(10) Patent No.: US 10,221,589 B2
(45) Date of Patent: Mar. 5, 2019

(54) ROCKER MECHANISM FOR LOCKING DOOR TRIM

(71) Applicant: Schlage Lock Company LLC, Carmel, IN (US)

(72) Inventors: Rockwood T. Roberts, III, Carmel, IN (US); Chris Pembridge, Jamestown, NY (US); Kun-Yen Tsai, Nantou (TW); Michael Grady, Londonberry, NH (US); Xiny Fan, Zhengzhou (CN); Caleb Jones, South Burlington, VT (US)

(73) Assignee: Schlage Lock Company LLC, Carmel, IN (US)

( * ) Notice: Subject to any disclaimer, the term of this patent is extended or adjusted under 35 U.S.C. 154(b) by 80 days.

(21) Appl. No.: 15/425,340

(22) Filed: Feb. 6, 2017

(65) Prior Publication Data

US 2018/0223564 A1 Aug. 9, 2018

(51) Int. Cl.

| | |
|---|---|
| ***E05B 63/22*** | (2006.01) |
| ***E05B 17/20*** | (2006.01) |
| ***E05B 55/00*** | (2006.01) |
| ***E05B 15/02*** | (2006.01) |
| ***E05B 1/00*** | (2006.01) |
| *E05B 63/00* | (2006.01) |

(52) U.S. Cl.

CPC ..... *E05B 63/22* (2013.01); *E05B 1/0038* (2013.01); *E05B 15/02* (2013.01); *E05B 17/2007* (2013.01); *E05B 17/2034* (2013.01); *E05B 55/005* (2013.01); *E05B 63/0069* (2013.01)

(58) Field of Classification Search

CPC ..... E05B 1/00; E05B 1/0038; E05B 1/0053; E05B 7/00; E05B 13/103; E05B 15/02; E05B 17/20; E05B 17/2007; E05B 17/203; E05B 17/2034; E05B 63/22

See application file for complete search history.

(56) References Cited

U.S. PATENT DOCUMENTS

| | | | | |
|---|---|---|---|---|
| 1,141,590 | A | 6/1915 | Turk | |
| 3,588,409 | A | 6/1971 | Lattinen | |
| 4,578,968 | A * | 4/1986 | Messier, Jr. | E05B 5/00 292/165 |
| 4,900,073 | A | 2/1990 | Doolan | |
| 5,010,749 | A * | 4/1991 | Lin | E05B 63/0017 70/190 |
| 5,199,285 | A * | 4/1993 | Lin | E05B 13/101 70/190 |

(Continued)

*Primary Examiner* — Christopher J Boswell

(74) *Attorney, Agent, or Firm* — Taft Stettinius & Hollister LLP

(57) ABSTRACT

A rose assembly for a door lock in which the rose assembly places the door lock in one of a locked state and an unlocked state. The rose assembly includes a rose moveable with respect to the door. The rose includes a first position, in which the door lock is locked, and a second position, in which the door lock is unlocked. The rose assembly includes a frame which surrounds the rose and in which the rose nests. Pivotal movement of the rose within the frame moves the door lock from the locked state to the unlocked state. The rose pivots at a door lever, and a pivot axis is offset from a centerline of the rose. A larger portion of the rose, defined by the pivot axis, unlocks the door when pressed and a smaller portion of the rose locks the door when pressed.

28 Claims, 5 Drawing Sheets

(56) References Cited

U.S. PATENT DOCUMENTS

| | | | | |
|---|---|---|---|---|
| 5,564,759 | A * | 10/1996 | McNutt | E05B 1/0053 292/139 |
| 6,145,358 | A * | 11/2000 | Wu | E05B 13/004 70/381 |
| 6,581,423 | B2 | 6/2003 | Lin | |
| 7,748,244 | B2 * | 7/2010 | Garza | E05B 63/0017 292/166 |
| 9,187,928 | B2 * | 11/2015 | Abel | E05B 41/00 |
| 9,493,965 | B2 * | 11/2016 | Viviano | E05B 33/00 |
| 2006/0144103 | A1 | 7/2006 | Blanch | |
| 2014/0007631 | A1 * | 1/2014 | Wood | E05B 63/08 70/357 |
| 2014/0311197 | A1 | 10/2014 | Abel et al. | |

* cited by examiner

ROCKER MECHANISM FOR LOCKING DOOR TRIM

FIELD OF THE INVENTION

The present disclosure relates to a security device, and more particularly to a door lock for securing a door.

BACKGROUND

Tubular lock mechanisms are commonly used in securing doors. One embodiment of a tubular lock mechanism is disclosed in U.S. Pat. No. 4,470,278 to Hale, the contents of which are incorporated by reference herein in their entirety. Some tubular locks have certain limitations such as those relating to convenient control of the locked/unlocked state of the lock as well as economical and efficient manufacture, construction and assembly. Therefore, a need remains for further improvements in this field of technology.

Many different door locks include decorative trim components to provide a level of visual appeal to a primarily functional product. One of the decorative components that can provide a significant enhancement to the overall appearance is the rosette or rose, also called an embellishment or escutcheon. Lock manufacturers typically offer a range of rose style options, including simple and cheap stamped brass roses, as well as more solid and stylish designs made from die cast zinc or forged brass. Cast or forged roses are very often non-round in shape and may have various ornate geometries. Due to their mass and shape, these types of roses require secure attachment and a positive orientation to the lock chassis. The most robust attachment approach is to permanently affix such roses to the lock chassis through a factory assembly process. However, it is increasingly desirable to provide a removable attachment means, such that the rose may be installed and/or removed as needed. To provide a clean and aesthetically pleasing appearance of a door lock, it is preferred that the lock mounting screws are hidden or covered by the decorative trim. This dictates that the rose must be attached to the lock chassis at the point of installation rather than by a factory assembly process. Under some circumstances, however, it may be desirable to change the lock trim style or finish periodically as a style update or upgrade.

The rose, as currently known by those skilled in the art, provides a merely cosmetic or decorative feature for a lock assembly. Most often the rose is configured to a cover portion of the door surrounding a hole in the door through which the lock assembly extends, which if not covered is considered unsightly. In addition, the rose protects a portion of the door from fingerprints and other materials, which are more easily cleaned from the rose than from the door. In some cases, the rose prevents unwanted foreign materials or objects from entering a chassis of the lock, which could reduce its effectiveness or intended operation. While the rose functions generally to provide ornamental features, these functions are limited. Consequently, what is need therefore is to enhance the functionality of the rose by providing additional features to improve the operation of the door lock.

SUMMARY

The present invention is directed to a rose assembly configured to lock and unlock a door lock. The rose assembly, or a portion thereof, is moveable between a locked position and an unlocked position to change the state of the lock.

In one embodiment, there is provided a lock assembly for a door, wherein the lock assembly includes a locked state and an unlocked state. The lock assembly includes a lock chassis, configured to place the lock assembly in one of the locked state and the unlocked state, and a rose. The rose includes a first position and a second position with respect to an exterior of the door and operatively coupled to the lock chassis, wherein the first position of the rose places the lock chassis in one of the unlocked state and the locked state and the second position of the rose places the lock chassis in the other of the unlocked state and the locked state.

In another embodiment, there is provided a rose assembly for a door including a door lock having a locked state and an unlocked state. The rose assembly includes a rose moveable with respect to an exterior of the door and operatively coupled to the door lock. Movement of the rose with respect to the door places the door lock in one of the unlocked state and the locked state.

In still another embodiment, there is provided a method for unlocking and locking a door lock coupled to a door. The method includes providing a rose having a first position and a second position with respect to the door, providing a locking actuator configured to place the lock in one of a locked and an unlocked state; placing the locking actuator in the locked state in response to the rose being in the first position; and placing the locking actuator in the unlocked state in response to the rose being in the second position.

DETAILED DESCRIPTION

Figure 1:
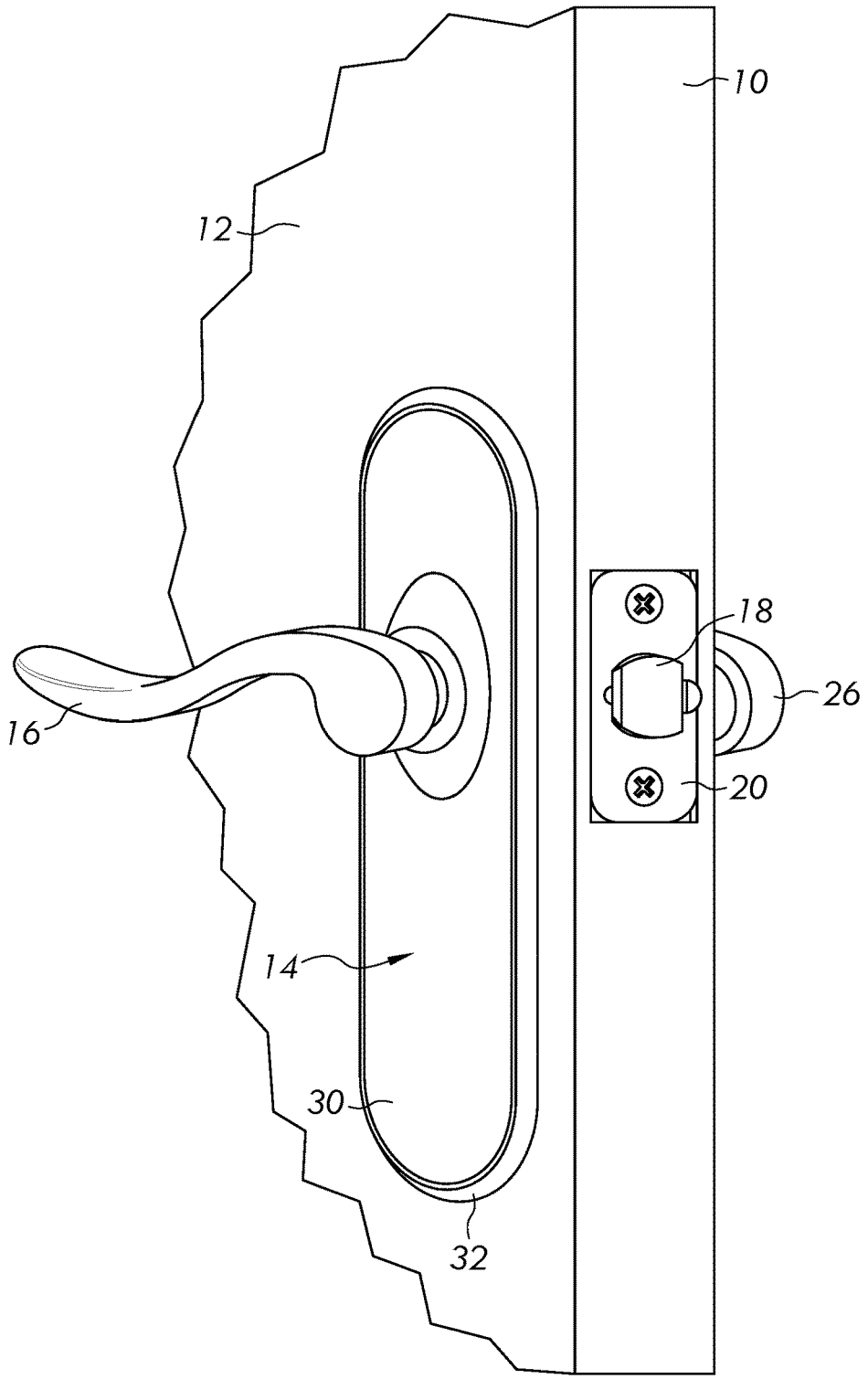
FIG. 1 is a perspective view of a portion of a door including a door lock having handles and a rose.

For the purposes of promoting an understanding of the principles of the invention, reference will now be made to the embodiments illustrated in the drawings where specific language is used to describe the same. It should be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
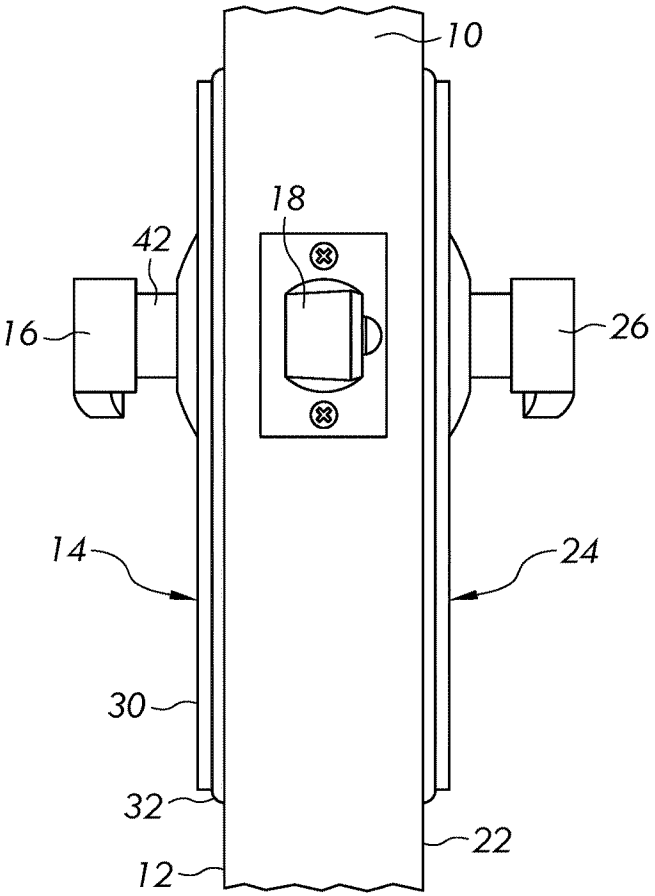
FIG. 2 is a side view of door including a door lock having handles, a rose, and a latch.

FIGS. 1 and 2 illustrate a portion of a door 10 including a first side 12 upon which a rose assembly 14 is mounted. The first side 12 defines a generally planar surface such that a back side of the rose assembly 14 mounts flush with the surface. Extending from the rose assembly 14 is a handle 16 configured to move a latch 18 which is bounded by a latch plate 20. A second side of the door 22 supports a rose assembly 24. A handle 26 extends from the rose assembly 24. The rose assembly 14 includes a rose plate 30 and a rose frame 32.

Figure 3:
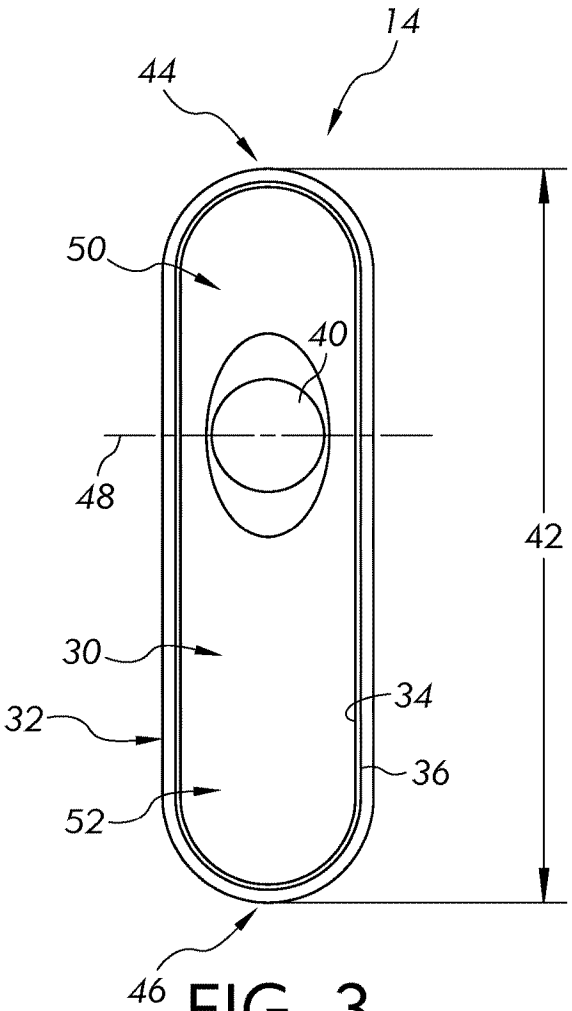
FIG. 3 is a plan view a rose.

As illustrated in FIG. 3, the rose plate 30 includes an outer edge 34 configured to fit within an inner edge 36 of the rose frame 32. The rose plate 30 includes an aperture or hole 40 which is configured to receive a shaft 42 of the handle 16.

In one embodiment, the rose assembly 14 is generally oval shaped and includes a length 42 extending from a top edge 44 to a bottom edge 46. The length of the rose plate 30 is less than the rose frame 32. The aperture 40 defines a horizontal line 48 which divides the rose assembly 14, as well as the rose frame 32, into a top portion 50 and a bottom portion 52. As can be seen, the top portion 50 includes less surface area than the bottom portion 52. In other embodiments, the rose assembly includes other shapes and sizes including circular, rectangular, and square.

Figure 4:
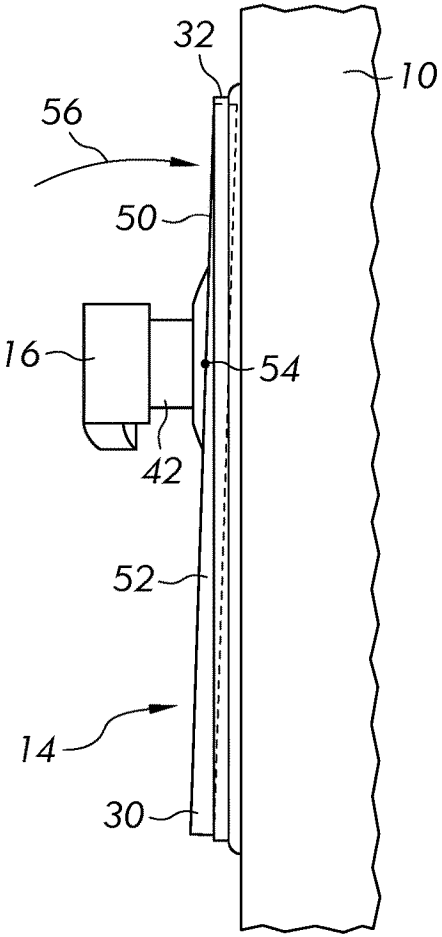
FIG. 4 is a side view of a rose assembly in a first position.

The horizontal line 48 defines a pivot axis 54 about which the rose plate 30 pivots with respect to the rose frame 32 as illustrated in FIG. 4. The lock and unlock function is provided by pivotal movement of the rose plate 30 about the pivot axis 54. Consequently, instead of having the lock/unlock function provided by a small button at the center of a handle or at another location, such as extending from a rose assembly, the entire rose assembly 14 functions to lock and unlock the door lock.

The door lock is unlocked or locked by pressing the appropriate top portion 50 or bottom portion 52 as needed. In one embodiment, the top portion 50, which is smaller, is pressed along a direction 56 to lock the door lock. The bottom portion 52, which is larger, is pressed along a direction 58 to unlock the door lock. (See FIG. 5) In this embodiment, the unlocking portion 52 is larger than the locking portion 50. The increased size of the unlocking portion 52 enables a user to more easily identify and locate the unlocking portion to unlock the door lock. Not only does the feature make the door easier to unlock due to the length of the lever arm as determined by the pivot axis 54, the door can be unlocked more quickly due to the size of the unlocking portion 52. In an emergency, such a feature would prove valuable. In other embodiments, the size of the top portion 50 and the bottom portion 52 are the same. In still other embodiments, the size of the top portion 50 is larger than the bottom portion. In still other embodiments, the pivot axis runs lengthwise or longitudinally along the length of the door. A left side and a right side of the rose locks and unlocks the door.

As described in FIG. 3, the rose plate 30 includes the outer edge 34 configured to fit within the inner edge 36 of the rose frame 32. The smaller perimeter of the rose plate 30 enables the rose place to move within the frame 32 when pivoted about the pivot axis 54. The rose frame 32 is fixed to the surface 12 of the door and remains fixed when the rose plate 30 moves from the locked position to the unlocked position. In one embodiment, when the surface of the rose pate 30 is substantially parallel to the door surface 12, the lock is in the unlocked position.

Figure 6:
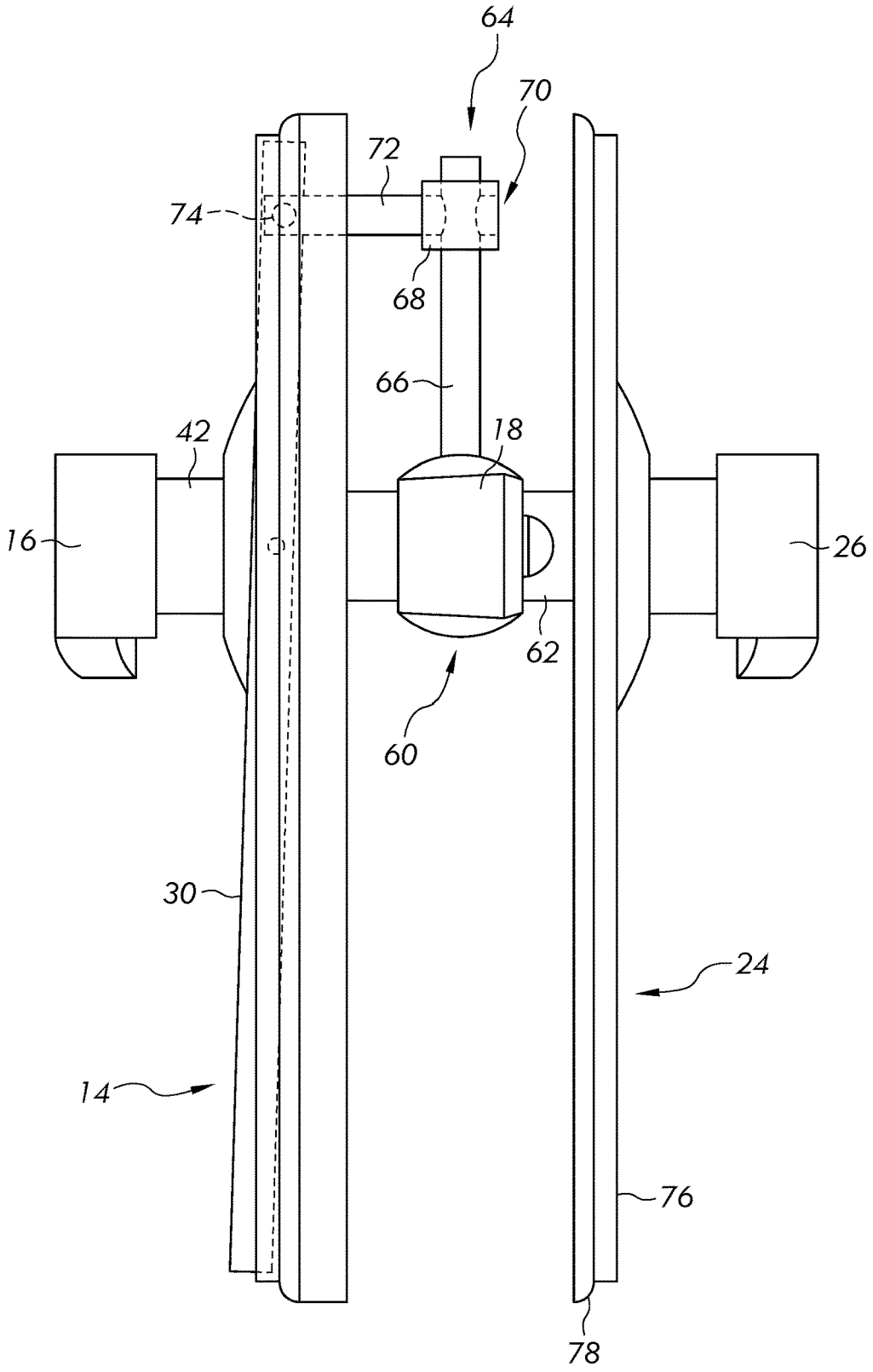
FIG. 6 is a schematic side view of a first rose assembly, a second rose assembly, and a locking mechanism activated by a rose plate.

FIG. 6 is a schematic side view of a lock assembly including the rose assembly 14 and a locking mechanism 60 activated by the rose plate 30. The door is not shown. The locking mechanism 60 includes a lock chassis 62 supporting the latch 18, as is understood by one skilled in the art. The lock chassis 62 is configured to place the latch 18 in one of the locked state and the unlocked state. An actuation mechanism 64, or locking actuator, is coupled to the lock chassis 62 and changes the state of the locking mechanism 60 between the locked state and the unlocked state.

Figure 5:
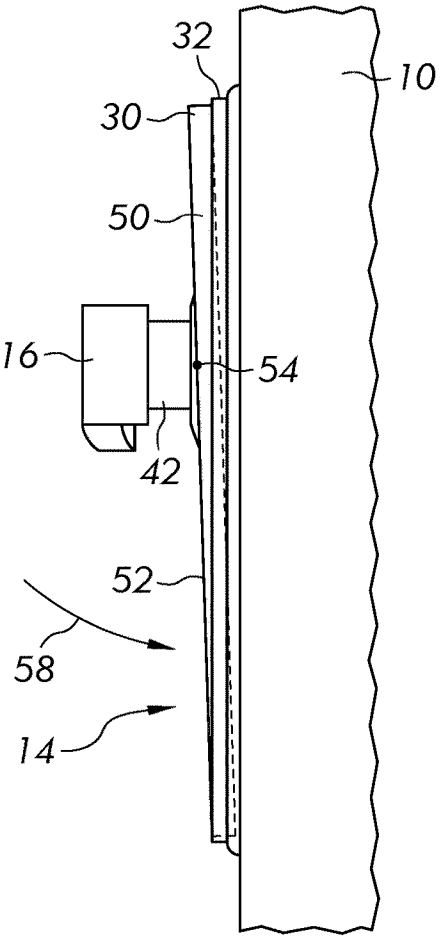
FIG. 5 is a side view of a rose in a second position.

In this embodiment, the locking actuator 64 includes a lock chassis extension 66 which extends from the lock chassis 62. The extension 66 includes a receiver 68 having an aperture 70 configured to receive a rod 72. The rod 72 is coupled to the rose plate 30 at a pin 74. When the rose plate 30 is located in the locked position, as illustrated in FIG. 6, the rod 72 extends into the aperture 70 to prevent the latch 18 from retracting from the hole of a strike plate attached to the door jamb. When the lower portion 52 of the rose plate 30 is depressed, such as illustrated in FIG. 5, the rod 72 is retracted from the receiver 70 and the latch 18 is free to move out of the strike plate to place the door lock in the unlocked state.

The rose assembly 24 includes a rose plate 76 coupled to a rose frame 78. In one embodiment, the rose plate 76 is fixedly coupled to the rose frame 78 and the rose assembly does not provide a lock or an unlock function. In another embodiment, the rose assembly 24 is a unitary one piece assembly. The rose plate 75 and the rose frame 78 are formed as a unitary part configured to resemble the rose assembly 14 when the exposed surface of the rose plate 30 is parallel to the surface 12 of the door.

Figure 7:
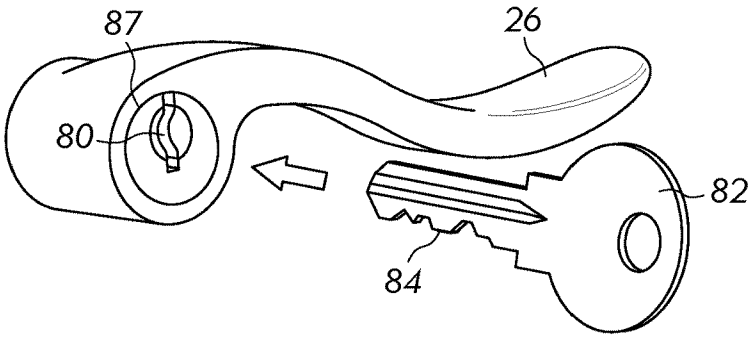
FIG. 7 is a perspective view of a door handle including a slot configured to accept a key.

FIG. 7 illustrates the handle 26 which includes an aperture 80 configured to receive a key 82. In the illustrated embodiment, the aperture 80 is a slot. The slot 80 directs the key 82, when inserted, toward a lock defeat of the lock chassis which overrides the lock if in the locked condition. In one embodiment, the lock chassis includes the lock override. In this embodiment, the slot replaces the known emergency unlocking mechanism which requires a small diameter pin to unlock the door. Because the hole which receives the small diameter pin has an uncommon size, it is often difficult find a correctly sized pin. The aperture 80, however, is sized to receive a blade 84 of the key 82. The aperture 80 is configured to receive blades of most keys and consequently readily provides access to the locked room when needed. In other embodiments, the aperture 80 is not a slot but includes other shapes and sizes configured to receive the blade 84. While FIG. 7 illustrates an outline 87 surrounding the aperture 80, in this embodiment, the outline does not signify that the slot 80 is rotatable with respect to the handle 26. The aperture 80 is fixed with the handle 26. In other embodiments, the slot 80 is configured to provide access to a lock chassis which locks and unlocks with an appropriately configured key.

Figure 8:
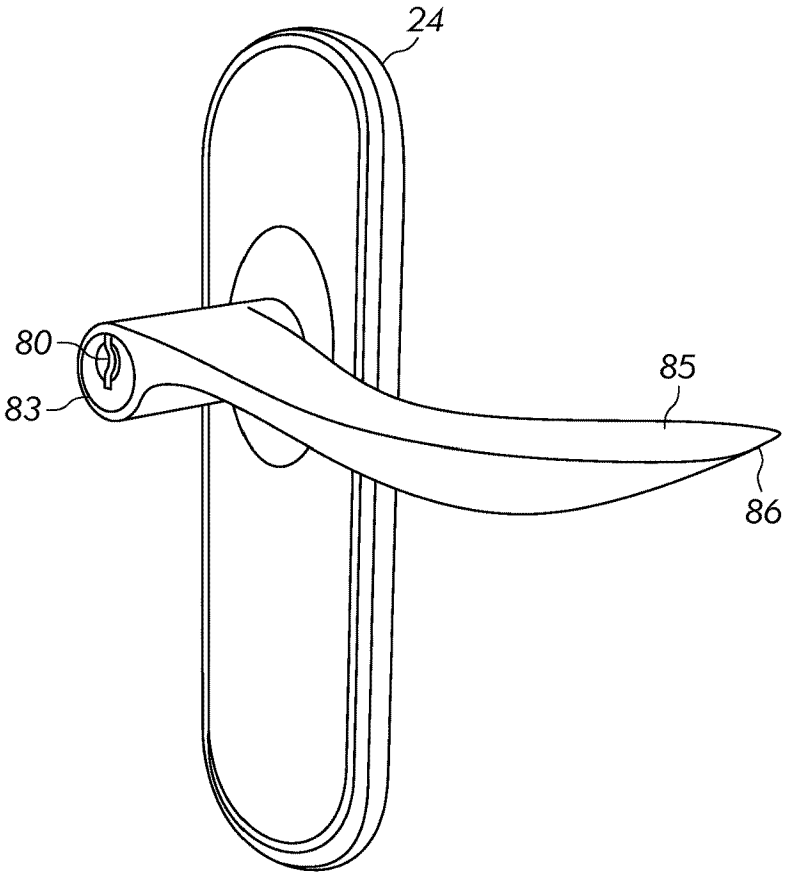
FIG. 8 is a perspective view of a door handle having a slot and a rose assembly.

FIG. 8 illustrates a perspective view of the rose assembly 24 and a handle 85. The handle 85 includes a length extending from one end 83, near the slot 80, to an end 86. The length is significantly longer than known handles and large enough to allow an individual to use a second hand on the additional length for added leverage. For instance, if an individual is physically disadvantaged, the extra length provides a longer lever arm and makes the door easier to open. In addition, the added length provides for pulling the handle down from a position below the handle, if necessary, should an individual fall and be located below the handle.

Figure 9:
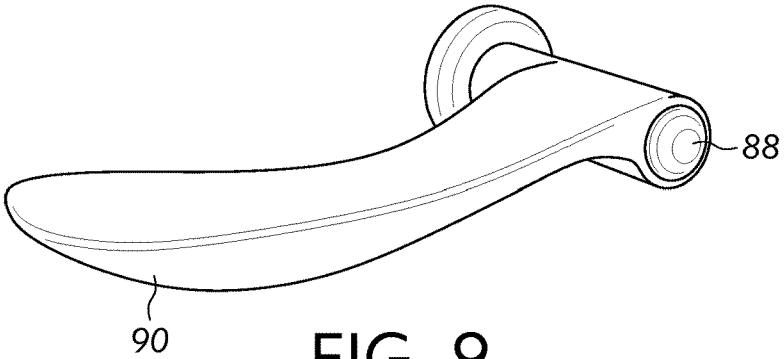
FIG. 9 is a perspective view of another embodiment of a door handle.

FIG. 9 illustrates a perspective view of a handle 90 including a shape similar to the handle 85. In this handle 90, a center portion 88 does not include the slot 80, as the slot is unnecessary due to a moveable rose plate being mounted at the handle 90. In other embodiments, the center portion 88 includes a slot.

While the invention has been illustrated and described in detail in the drawings and foregoing description, the same is to be considered as illustrative and not restrictive in character, it being understood that preferred embodiments have been shown and described and that all changes and modifications that come within the spirit of the inventions are desired to be protected. For instance in another embodiment, a rose plate is configured to slide with respect to surface of the door. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A lock assembly for a door, the lock assembly having a locked state and an unlocked state, the lock assembly comprising:

a lock chassis configured to place the lock assembly in one of the locked state and the unlocked state; and a rose including a first position and a second position with respect to an exterior of the door and operatively coupled to the lock chassis, wherein the first position of the rose places the lock chassis in one of the unlocked state and the locked state and the second position of the rose places the lock chassis in the other of the unlocked state and the locked state.

2. The lock assembly of claim 1 further comprising a rose housing disposed adjacently to the exterior of the door and the rose movably disposed with respect to the rose housing, wherein movement of the rose with respect to the rose housing places the lock chassis in one of the unlocked state and the locked state.

3. The lock assembly of claim 2 further comprising a drive operatively coupled to the rose and to a locking feature, wherein movement of the rose moves the drive to engage the locking feature to place the lock chassis in one of the locked state and the unlocked state.

4. The lock assembly of claim 3 wherein the rose includes a pivot member disposed between a first end of the rose and a second end of the rose, wherein the rose is pivotally moveable with respect to the housing at the pivot member and pivotal movement of the rose places the lock assembly in one of the unlocked state and the locked state.

5. The lock assembly of claim 4 wherein the rose defines a length from the first end to the second end and the pivot member defines a pivot axis disposed between the first end and the second end at other than a halfway point along the length.

6. The lock assembly of claim 5 wherein the rose defines an exposed surface, having a first exposed portion extending from the pivot axis to the first end, and a second exposed portion, extending from the pivot axis to the second end, wherein a length of the first exposed portion is less than a length of the second exposed portion.

7. The lock assembly of claim 6 wherein when the rose is in the first positon and the locking feature is in the locked state, the first end of the first portion is closer to the door exterior than the second end.

8. The lock assembly of claim 7 wherein when the rose is in the second position and the locking feature is in the unlocked state, the second end of the second portion is closer to the door exterior than the first end.

9. The lock assembly of claim 3 wherein the lock includes a slotted aperture configured to receive a blade of a key and the lock chassis includes a lock override, wherein translational movement of the blade in the slotted aperture moves the blade into contact with the lock override to place the lock chassis in an unlocked state if in a locked state.

10. The lock assembly of claim 1 further comprising a rose housing having an inward side configured to abut the exterior of the door and an opposite outward side; wherein the rose is pivotably mounted to the outward side of the rose housing.

11. The lock assembly of claim 10 further comprising a handle having a handle shaft, wherein the handle shaft extends outwardly from the rose plate, wherein the handle is operable to pivot relative to the rose plate about a second axis transverse to the first axis.

12. The lock assembly of claim 1 wherein the lock chassis is configured to move the lock assembly from the unlocked state to the locked state in response to movement of the rose from the first position to the second position; and wherein the lock chassis is configured to move the lock assembly from the locked state to the unlocked state in response to movement of the rose from the second position to the first position.

13. A rose assembly for a door including a door lock having a locked state and an unlocked state, the rose assembly comprising:

a rose moveable with respect to an exterior of the door and operatively coupled to the door lock, wherein movement of the rose with respect to the door places the door lock in one of the unlocked state and the locked state;

wherein movement of the rose from a first position to a second position moves the door lock from the locked state to the unlocked state; and wherein movement of the rose from the second position to the first position moves the door lock from the unlocked state to the locked state.

14. The rose assembly of claim 13 further comprising a rose housing disposed adjacently to the exterior of the door and the rose movably disposed with respect to the rose housing, wherein movement of the rose with respect to the rose housing places the door lock in one of the unlocked state and the locked state.

15. The rose assembly of claim 14 further comprising a drive operatively coupled to the rose and to the door lock, wherein movement of the rose moves the drive to place the door lock in one of the locked state and the unlocked state.

16. The rose assembly of claim 15 wherein the rose includes a pivot member disposed between a first end of the rose and a second end of the rose, wherein the rose is pivotally moveable with respect to the rose housing at the pivot member and pivotal movement of the rose places the door lock in one of the unlocked state and the locked state.

17. The rose assembly of claim 16 wherein the rose defines a length from the first end to the second end and the pivot member defines a pivot axis disposed between the first end and the second end and at other than a halfway point along the length.

18. The rose assembly of claim 17 wherein the rose defines an exposed surface, having a first exposed portion extending from the pivot axis to the first end, and a second exposed portion, extending from the pivot axis to the second end, wherein a length of the first exposed portion is less than a length of the second exposed portion.

19. The rose assembly of claim 18 wherein the first end of the first portion is closer to the door exterior than the second end when the rose is in the first position and the door lock is the locked state.

20. The rose assembly of claim 19 wherein the second end is closer to the door exterior than the first end when the rose is in the second position and the door lock is in the unlocked state.

21. The rose assembly of claim 15 wherein the door lock includes a lock override and a slotted aperture configured to receive a blade of a key, wherein translational movement of the blade in the slotted aperture moves the blade into contact with the lock override and places the door lock in an unlocked state if in a locked state.

22. The rose assembly of claim 13, further comprising a rose housing, wherein the rose housing includes a planar rear side defining a plane, wherein the rose is pivotably mounted to the rose housing such that the rose pivots about a pivot axis parallel to the plane.

23. A method for unlocking and locking a door lock coupled to a door, the method comprising;

providing a rose having a first position and a second position with respect to the door, providing a locking actuator configured to place the lock in one of a locked and an unlocked state;

placing the locking actuator in the locked state in response to the rose being in the first position; and placing the locking actuator in the unlocked state in response to the rose being in the second position.

24. The method of claim 23 wherein providing the rose includes providing a rose a having a pivot axis about which the rose pivots.

25. The method of claim 24 wherein placing the locking apparatus in the locked state includes placing the locking apparatus in the lock state in response to pivotal movement of the rose about the pivot axis in a first direction.

26. The method of claim 25 wherein placing the locking apparatus in the unlocked state includes placing the locking apparatus in the unlocked state in response to pivotal movement of the rose about the pivot axis in a second direction.

27. The method of claim 23, wherein placing the locking actuator in the locked state in response to the rose being in the first position comprises moving the locking actuator from the unlocked state to the locked state in response to movement of the rose from the second position to the first position, and wherein placing the locking actuator in the unlocked state in response to the rose being in the second position comprises moving the locking actuator from the locked state to the unlocked state in response to movement of the rose from the first position to the second position.

28. The lock assembly of claim 27 wherein the rose is operable to pivot relative to the rose plate about a pivot axis extending along the rose housing.

* * * * *